US007080741B1

(12) United States Patent
Butzin et al.

(10) Patent No.: US 7,080,741 B1
(45) Date of Patent: Jul. 25, 2006

(54) MULTIFUNCTIONAL APPARATUS FOR USE IN AGRICULTURAL APPLICATIONS

(76) Inventors: Gordon W. Butzin, 184 S. State St., Berlin, WI (US) 54923; Barbara Butzin, 184 S. State St., Berlin, WI (US) 54923

( * ) Notice: Subject to any disclaimer, the term of this patent is extended or adjusted under 35 U.S.C. 154(b) by 0 days.

(21) Appl. No.: 10/901,727

(22) Filed: Jul. 30, 2004

(51) Int. Cl.
*B07B 13/05* (2006.01)
*B07B 13/07* (2006.01)
*B07B 13/075* (2006.01)
*B07B 5/12* (2006.01)

(52) U.S. Cl. ..... 209/664; 209/293; 209/689; 210/760; 210/416.1

(58) Field of Classification Search ..... 209/664, 209/293, 689; 210/760, 416.1
See application file for complete search history.

(56) References Cited

U.S. PATENT DOCUMENTS 3,810,548 A 5/1974 Blough
3,838,199 A 9/1974 Coe et al.
3,875,319 A 4/1975 Seckler et al.
4,077,509 A 3/1978 Berg, Jr.
4,338,337 A 7/1982 Frankl
4,468,463 A 8/1984 Arsovic
6,071,418 A * 6/2000 Tai ..... 210/760
6,113,800 A * 9/2000 Hopkins et al. ..... 210/703
6,305,552 B1 * 10/2001 Coleman ..... 209/664

* cited by examiner

*Primary Examiner*—Kathy Matecki
*Assistant Examiner*—Terrell Matthews

(57) ABSTRACT

A multifunctional apparatus for use in agricultural applications includes a stationary section including a primary chassis having a plurality of leg members attached thereto. The stationary section further includes a reservoir connected to the chassis and supported above a ground surface and a power-operable air compressor secured to the reservoir. The apparatus further includes a movable section including a secondary chassis and a cage attached thereto. The secondary chassis includes a hinge and a bracket secured thereto. The cage includes a lid member removably attachable thereto and an access door pivotally connected thereto. The apparatus further includes a power mechanism for rotating the movable section and a mechanism for mixing the products disposed within the movable section. The mixing and power mechanisms are independently rotatable during operating conditions.

15 Claims, 5 Drawing Sheets

MULTIFUNCTIONAL APPARATUS FOR USE IN AGRICULTURAL APPLICATIONS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to agricultural product mixing apparatuses and, more particularly, to a mixing apparatus for separating earthworms from their castings.

2. Prior Art

In nature, composting worms tend to be highly localized, thriving in pockets of highly enriched organic materials. They consume a great variety of organic wastes and excrete worm castings, a highly valued soil conditioner used in potting soil. Worm-worked composts have better texture and greater soil-enhancing properties than ordinary composts and typically retain higher percentages of nitrogen, potassium, and phosphorous. During the processing of manure by earthworms into castings, many of the nutrients they contain are transformed into forms more readily taken up by plants, such as nitrate nitrogen, exchangeable phosphorous, soluble potassium, calcium and magnesium.

Because their castings provide valuable nutrients to the soil, commercial earthworm growers require separation of the earthworms from their castings in order to process and sell pure castings for use in potting soil. Accordingly, a need remains for an apparatus to economically and efficiently separate earthworms from their castings in order to produce effective potting soil for plants. The present invention satisfies such a need by providing a large capacity, separating mechanism that is powered by a motor.

BRIEF SUMMARY OF THE INVENTION

In view of the foregoing background, it is therefore an object of the present invention to provide an apparatus for separating earthworms from their castings. These and other objects, features, and advantages of the invention are provided by a mixing apparatus that receives and separates earthworms from their associated castings in order to produce high-quality composting soil.

Such an apparatus includes a stationary section including a primary chassis having a plurality of leg members attached thereto and extending downwardly therefrom. The stationary section further includes a reservoir connected to the chassis and supported above a ground surface. The reservoir further includes at least one manually-operable valve in fluid communication therewith and selectively movable between open and closed positions for draining agricultural product waste during operating conditions.

The stationary section further includes a power-operable air compressor secured to the reservoir. The air compressor is provided with a plurality of flexible conduits having opposed end portions connected thereto and selectively positionable within the reservoir respectively so that the products can be adequately aerated during operating conditions.

The apparatus further includes a movable section including a secondary chassis and a cage attached thereto. The cage includes a centrally disposed longitudinal shaft provided with a plurality of spaced spokes extending radially outwardly therefrom and along a partial length of the reservoir. The secondary chassis includes a hinge and a bracket secured thereto wherein the hinge spans across a width of the primary chassis so that the cage can be pivoted about one end portion of the secondary chassis between raised and lowered positions for receiving and processing the products therein respectively. The cage includes a lid member removably attachable thereto to prevent a user from introducing agricultural products into the cage and an access door pivotally connected thereto and being disposed medially along a length thereof. Such a door allows a user to position the products directly into the cage without having to feed the products through a top end portion thereof. The top end portion of the cage includes a screen member having a mesh surface for selectively filtering the products before entering the cage.

The apparatus further includes a power mechanism for rotating the movable section along a first radial direction and being operably connected to the secondary chassis. The power mechanism includes an electric motor including a drive pulley provided with a belt attached thereto and a drive shaft extending outwardly therefrom and operably connected to the reservoir. The motor further includes a belt connected thereto and at least one bearing journaled about the shaft. The motor is selectively operable by a user wherein the reservoir can be manually rotated when the motor is at an off position.

The apparatus also includes a mechanism for mixing the products disposed within the movable section wherein the mixing and power mechanisms are independently rotatable during operating conditions and the mixing mechanism rotates in a second radial direction. The mixing mechanism includes a first propeller operably connected to the shaft and being powered by the motor. The propeller has a plurality of blades disposed within the cage for assisting a user to control the rate at which the products are mixed during operating conditions.

The mixing mechanism further includes a plurality of auger paddles disposed adjacent one end portion of the cage and the reservoir respectively. Such auger paddles assist a user to feed and discharge the products during operating conditions. The mixing mechanism further includes a shutter removable positionable into the reservoir and having a mesh body for selectively filtering the products received from the cage and a second propeller having a hand-operable motor attached thereto and positioned within the reservoir so that a user can selectively mix the products before passing through the shutter.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
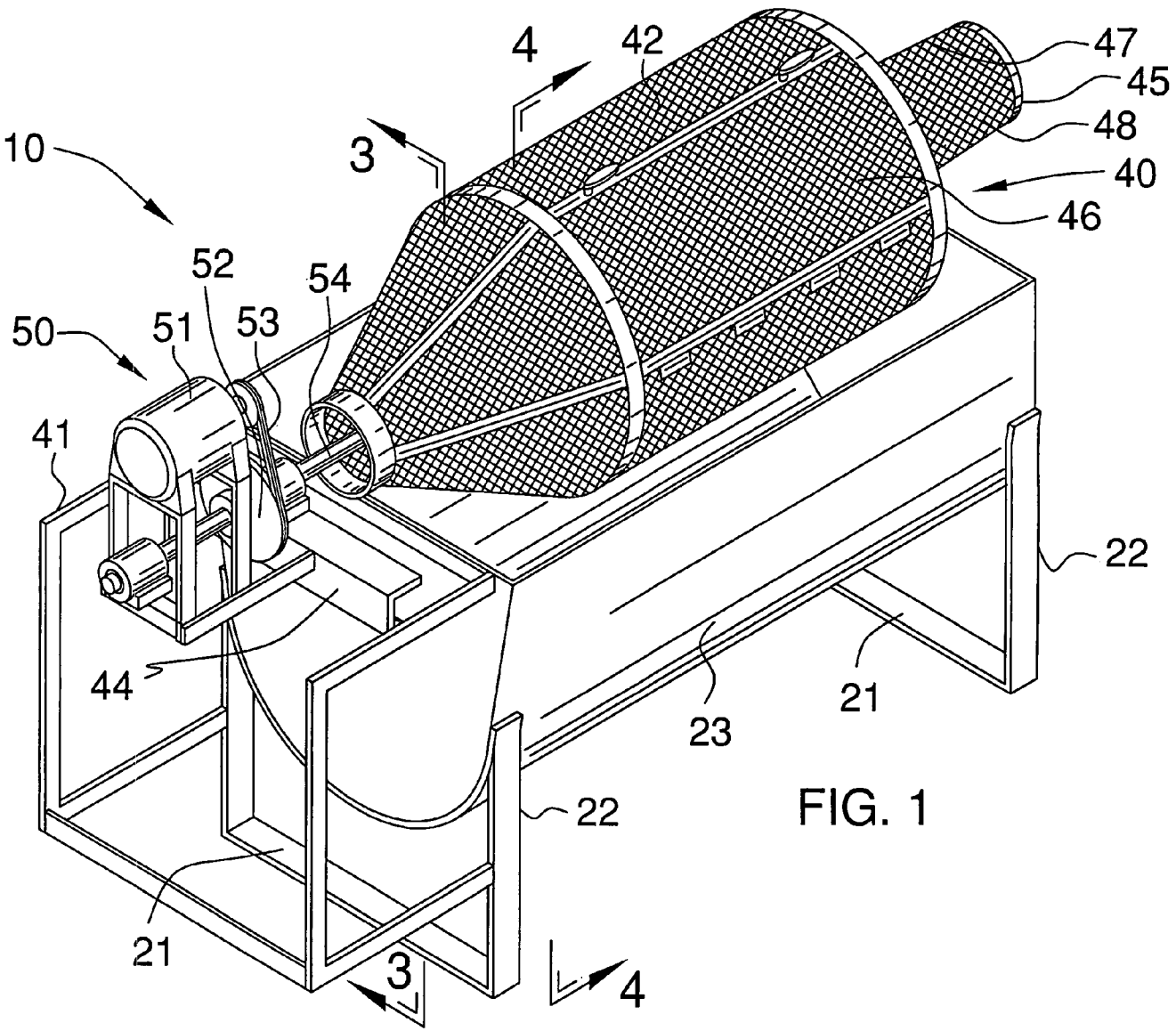
FIG. 1 is a perspective view of a multifunctional apparatus for use in agricultural applications, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–6 by the reference numeral 10 and is intended to provide a multifunctional apparatus for agricultural applications. It should be understood that the apparatus 10 may be used to process and separate many different types of agricultural products and should not be limited to earthworms or manure.

Initially referring to FIG. 1, the apparatus 10 includes a stationary section 20 including a primary chassis 21 having a plurality of leg members 22 attached thereto and extending downwardly therefrom. The stationary section 20 further includes a reservoir 23 connected to the chassis 21 and supported above a ground surface.

Figure 2:
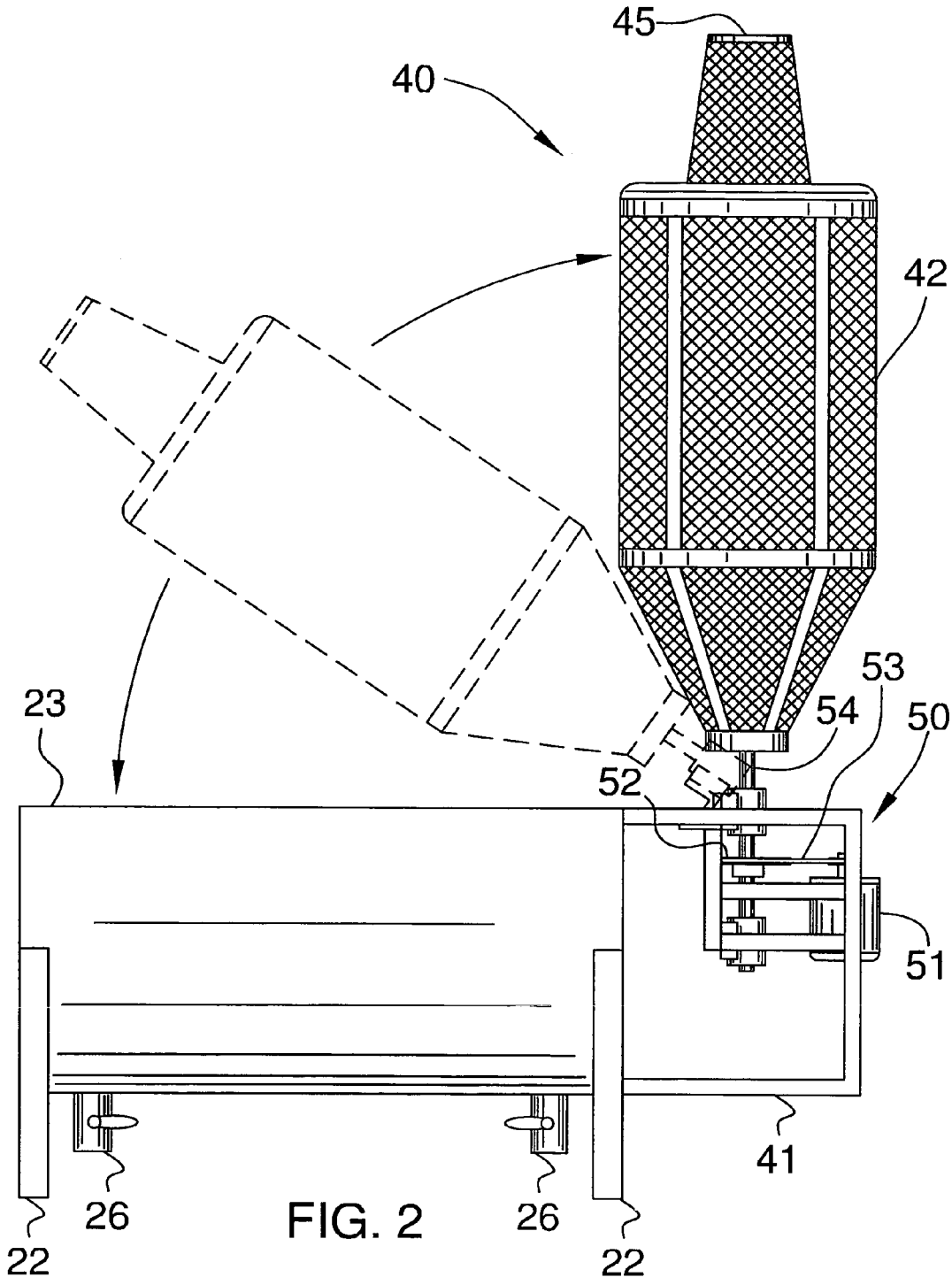
FIG. 2 is a side elevational view illustrating the movement of the cage between raised and lowered positions.

The reservoir 23 further includes at least one manually-operable valve 26 in fluid communication therewith and selectively movable between open and closed positions for draining agricultural product waste during operating conditions, as best shown in FIG. 2. Advantageously, the valve 26 enables a user to drain excess fluids and waste manually without power, saving fuel costs and wear and tear on the apparatus 10.

Figure 6:
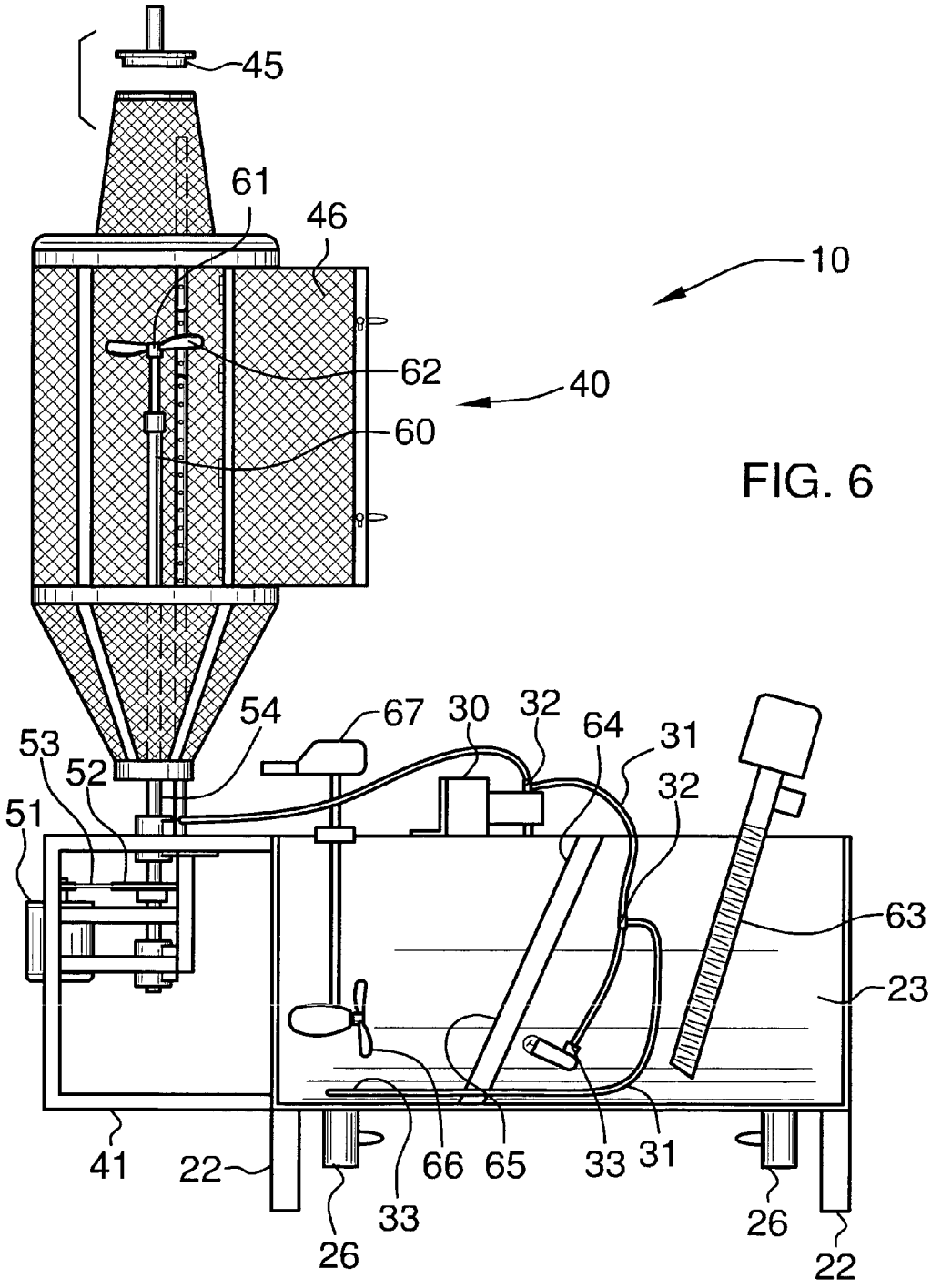
FIG. 6 is a cross-sectional view of the present invention shown in FIGS. 1 and 2, taken along line 6—6.

Referring to FIG. 6, the stationary section 20 further includes a power-operable air compressor 30 secured to the reservoir 23. Such an air compressor 30 is provided with a plurality of flexible conduits 31 having opposed end portions 32, 33 connected thereto and selectively positionable within the reservoir 23 respectively so that the products can be adequately aerated during operating conditions. The aeration process allows solid wastes to settle faster and enables the apparatus 10 to run faster and more efficiently.

Figure 4:
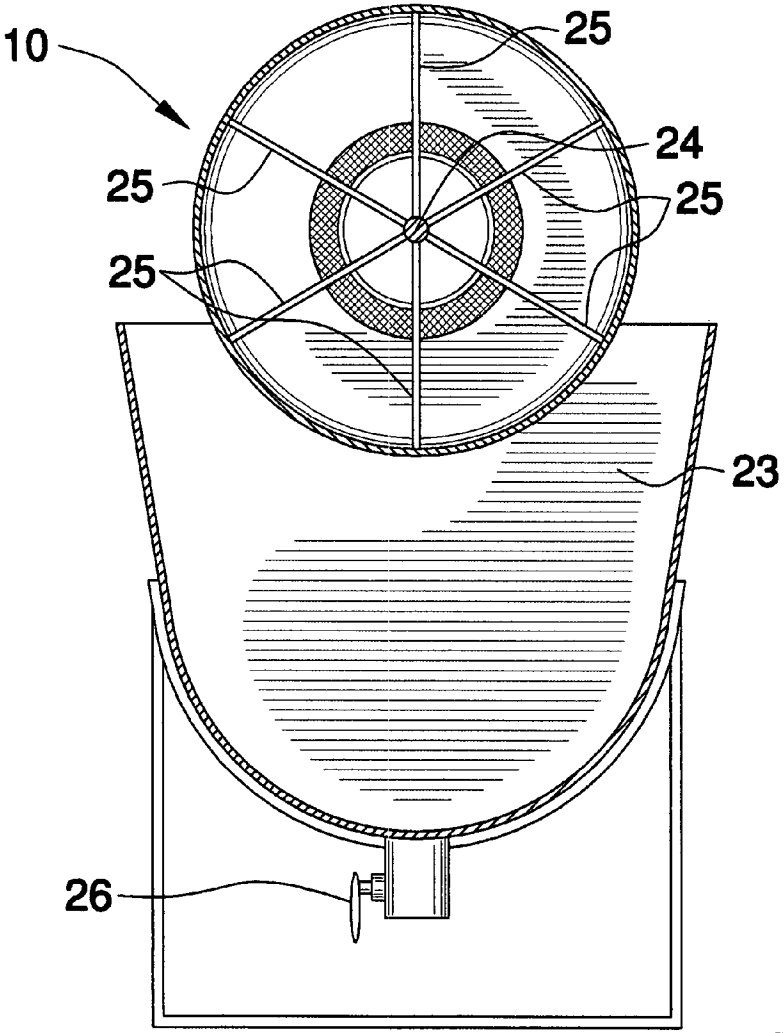
FIG. 4 is a cross-sectional view showing the cage and reservoir, taken along line 4—4.

Still referring to FIG. 6, the apparatus 10 further includes a movable section 40 including a secondary chassis 41 and a cage 42 attached thereto. Such a cage 42 includes a centrally disposed longitudinal shaft 24 provided with a plurality of spaced spokes 25 extending radially outwardly therefrom and along a partial length of the reservoir 23, as best shown in FIG. 4. The secondary chassis 41 includes a hinge 43 and a bracket 44 secured thereto wherein the hinge 43 spans across a width of the primary chassis 21 so that the cage 42 can be pivoted about one end portion of the secondary chassis 41 between raised and lowered positions for receiving and processing the products therein respectively, as shown in FIG. 2.

The cage 42 includes a lid member 45 removably attachable thereto to prevent a user from introducing agricultural products into the cage 42 and an access door 46 pivotally connected thereto and being disposed medially along a length thereof. Such a door 46 allows a user to position the products directly into the cage 42 without having to feed the products through a top end portion 47 thereof, ensuring greater productivity so that a large capacity can be processed in a short amount of time. The large capacity of the apparatus 10 reduces labor costs and increases its ease of operation. The top end portion 47 of the cage 42 includes a screen member 48 having a mesh surface for selectively filtering the products before entering the cage 42. This eliminates any large unwanted items such as rocks, branches, or other debris from contaminating the castings and thereby reducing its effectiveness.

Figure 3:
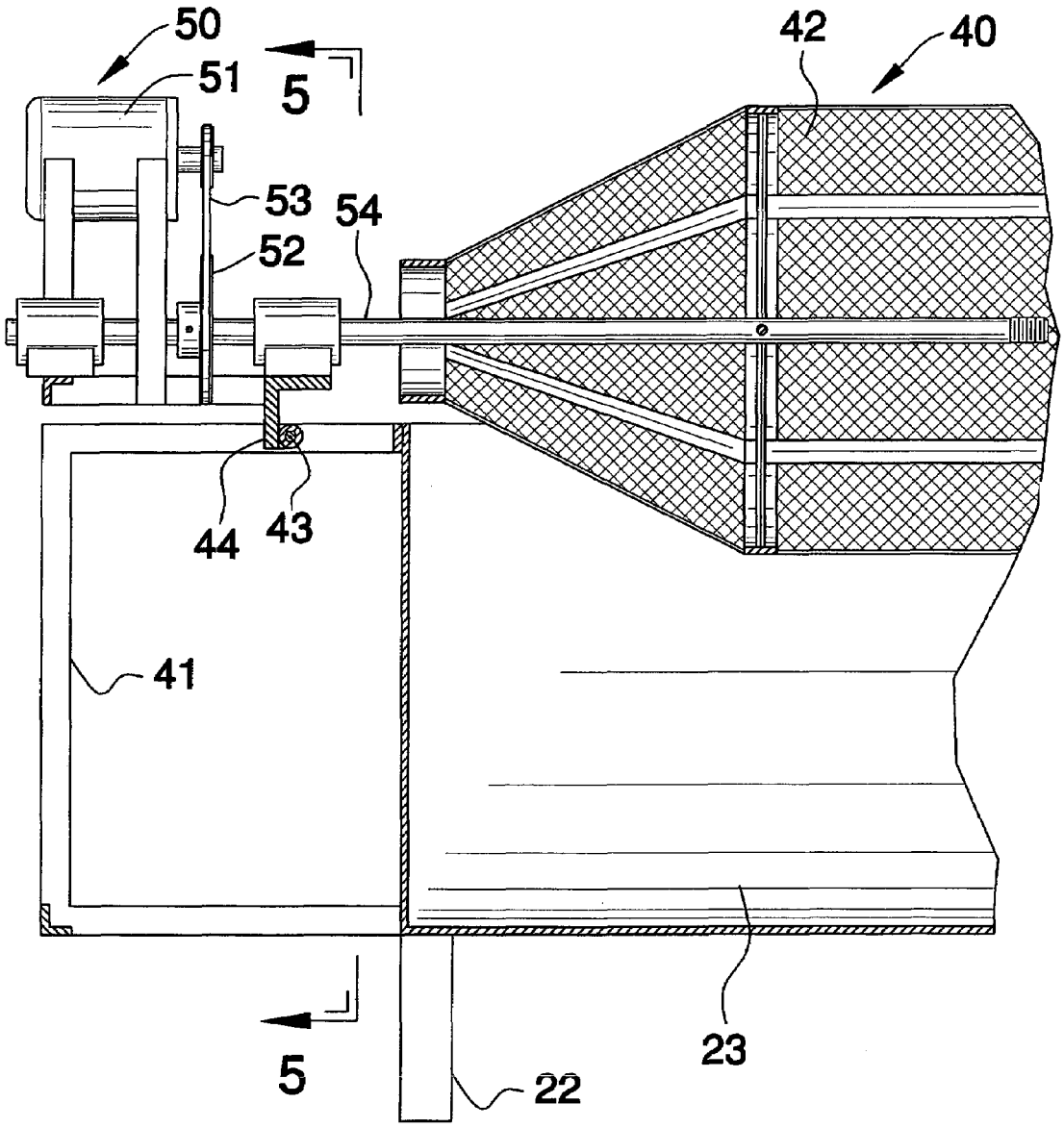
FIG. 3 is a partial cross-sectional view showing the power mechanism.
Figure 5:
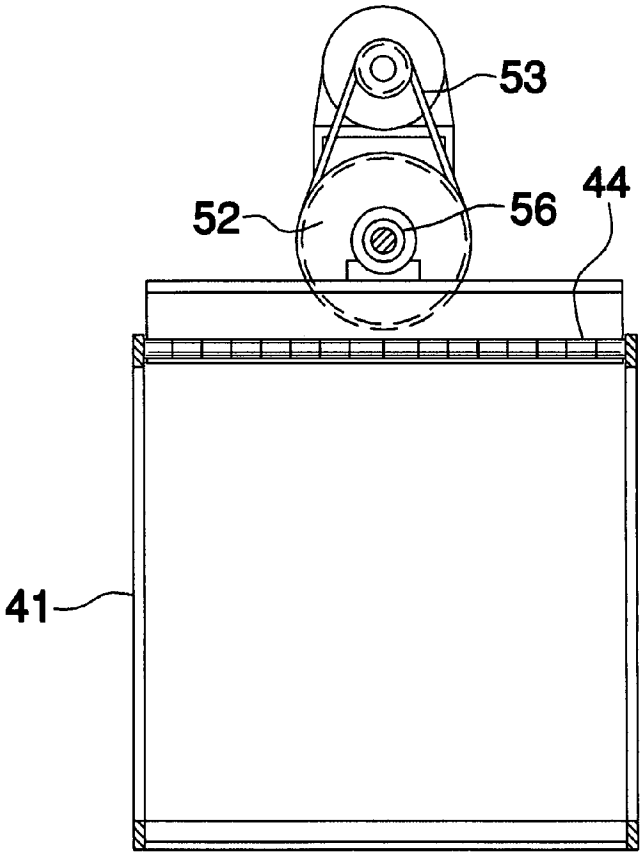
FIG. 5 is a cross-sectional view showing the power mechanism and secondary chassis including a hinge and an associated bracket, taken along line 5—5.

Now referring to FIG. 3, the apparatus 10 further includes a power mechanism 50 for rotating the movable section 40 along a first radial direction and being operably connected to the secondary chassis 41. The power mechanism 50 includes an electric motor 51 including a drive pulley 52 provided with a belt 53 attached thereto and a drive shaft 54 extending outwardly therefrom and operably connected to the reservoir 23. The motor 51 further includes at least one bearing 56 journaled about the shaft 54, as shown in FIG. 5. The motor 51 is selectively operable by a user wherein the reservoir 23 can be manually rotated when the motor 51 is at an off position. The power mechanism 50 has relatively few moving parts, reducing the chance of breakdowns and limiting the time and costs of such breakdowns when they do occur. As a result, overall costs are minimized.

Referring back to FIG. 6, the apparatus 10 also includes a mechanism 60 for mixing the products disposed within the movable section wherein the mixing 60 and power 50 mechanisms are independently rotatable during operating conditions. The mixing mechanism 60 rotates in a second radial direction. The mixing mechanism 60 includes a first propeller 61 operably connected to the shaft 54 and being powered by the motor 51. The propeller 61 has a plurality of blades 62 disposed within the cage 42 for assisting a user to control a rate at which the products are mixed during operating conditions.

Still referring to FIG. 6, the mixing mechanism 60 further includes a plurality of auger paddles 63 disposed adjacent one end portion of the cage 42 and the reservoir 23 respectively. Such auger paddles 63 assist a user to feed and discharge the products during operating conditions. The mixing mechanism 60 further includes a shutter 64 removable positionable into the reservoir 23 and having a mesh body 65 for selectively filtering the products received from the cage 42 and a second propeller 66 having a hand-operable motor 67 attached thereto and positioned within the reservoir 23 so that a user can selectively mix the products before passing through the shutter 64.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and desired by Letters Patent of the United States is:

1. An apparatus for separating worms from their associated castings, said apparatus comprising:

a stationary section including a primary chassis and a reservoir connected thereto and supported above a ground surface, said reservoir further including at least one manually-operable valve in fluid communication therewith and selectively movable between open and closed positions for draining agricultural product waste during operating conditions, said stationary section further including a power-operable air compressor secured to said reservoir, said air compressor being provided with a plurality of flexible conduits having opposed end portions connected thereto and selectively positionable within said reservoir respectively so that agricultural products can be adequately aerated during operating conditions;

a movable section including a secondary chassis and a cage attached thereto, said cage including a centrally disposed longitudinal shaft provided with a plurality of spaced spokes extending radially outwardly therefrom and along a partial length of said reservoir, said secondary chassis including a hinge and a bracket secured thereto wherein said hinge spans across a width of said primary chassis so that said cage can be pivoted about one end portion of said secondary chassis between raised and lowered positions for receiving and processing the products therein respectively;

power means for rotating said movable section along a first radial direction, said power means being operably connected to said secondary chassis; and means for mixing the products disposed within said movable section, said mixing and power means being independently rotatable during operating conditions wherein said mixing means rotates in a second radial direction.

2. The apparatus of claim 1, wherein said power means comprises:

an electric motor including a drive pulley provided with a belt attached thereto and a drive shaft extending outwardly therefrom and operably connected to said reservoir, said motor further including a belt connected thereto and at least one bearing journaled about said shaft, said motor being selectively operable by a user wherein said reservoir can be manually rotated when said motor is at an off position.

3. The apparatus of claim 2, wherein said mixing means comprises:

a first propeller operably connected to said shaft and being powered by said motor, said propeller having a plurality of blades disposed within said cage for assisting a user to control a rate at which the products are mixed during operating conditions;

a plurality of auger paddles disposed adjacent one end portion of said cage and said reservoir respectively, said auger paddles for assisting a user to feed and discharge the products during operating conditions; and a shutter removable positionable into said reservoir and having a mesh body for selectively filtering the products received from said cage; and a second propeller having a hand-operable motor attached thereto and positioned within said reservoir so that a user can selectively mix the products before passing through said shutter.

4. The apparatus of claim 1, wherein said cage further comprises:

an access door pivotally connected thereto and being disposed medially along a length thereof, said door for allowing a user to position the products directly into said cage without having to feed the products through a top end portion thereof.

5. The apparatus of claim 4, wherein said top end portion of said cage includes a screen member having a mesh surface for selectively filtering the products before entering said cage.

6. An apparatus for separating worms from their associated castings, said apparatus comprising:

a stationary section including a primary chassis having a plurality of leg members attached thereto and extending downwardly therefrom, said stationary section further including a reservoir connected to said chassis and supported above a ground surface, said reservoir further including at least one manually-operable valve in fluid communication therewith and selectively movable between open and closed positions for draining agricultural product waste during operating conditions, said stationary section further including a power-operable air compressor secured to said reservoir, said air compressor being provided with a plurality of flexible conduits having opposed end portions connected thereto and selectively positionable within said reservoir respectively so that agricultural products can be adequately aerated during operating conditions;

a movable section including a secondary chassis and a cage attached thereto, said cage including a centrally disposed longitudinal shaft provided with a plurality of spaced spokes extending radially outwardly therefrom and along a partial length of said reservoir, said secondary chassis including a hinge and a bracket secured thereto wherein said hinge spans across a width of said primary chassis so that said cage can be pivoted about one end portion of said secondary chassis between raised and lowered positions for receiving and processing the products therein respectively;

power means for rotating said movable section along a first radial direction, said power means being operably connected to said secondary chassis; and means for mixing the products disposed within said movable section, said mixing and power means being independently rotatable during operating conditions wherein said mixing means rotates in a second radial direction.

7. The apparatus of claim 6, wherein said power means comprises:

an electric motor including a drive pulley provided with a belt attached thereto and a drive shaft extending outwardly therefrom and operably connected to said reservoir, said motor further including a belt connected thereto and at least one bearing journaled about said shaft, said motor being selectively operable by a user wherein said reservoir can be manually rotated when said motor is at an off position.

8. The apparatus of claim 7, wherein said mixing means comprises:

a first propeller operably connected to said shaft and being powered by said motor, said propeller having a plurality of blades disposed within said age for assisting a user to control a rate at which the products are mixed during operating conditions;

a plurality of auger paddles disposed adjacent one end portion of said cage and said reservoir respectively, said auger paddles for assisting a user to feed and discharge the products during operating conditions; and a shutter removable positionable into said reservoir and having a mesh body for selectively filtering the products received from said cage; and a second propeller having a hand-operable motor attached thereto and positioned within said reservoir so that a user can selectively mix the products before passing through said shutter.

9. The apparatus of claim 6, wherein said cage further comprises:

an access door pivotally connected thereto and being disposed medially along a length thereof, said door for allowing a user to position the products directly into said cage without having to feed the products through a top end portion thereof.

10. The apparatus of claim 9, wherein said top end portion of said cage includes a screen member having a mesh surface for selectively filtering the products before entering said cage.

11. An apparatus for separating worms from their associated castings, said apparatus comprising:

a stationary section including a primary chassis having a plurality of leg members attached thereto and extending downwardly therefrom, said stationary section further including a reservoir connected to said chassis and supported above a ground surface, said reservoir further including at least one manually-operable valve in fluid communication therewith and selectively movable between open and closed positions for draining agricultural product waste during operating conditions, said cage including a lid member removably attachable thereto to prevent a user from introducing agricultural products into said cage, said stationary section further including a power-operable air compressor secured to said reservoir, said air compressor being provided with a plurality of flexible conduits having opposed end portions connected thereto and selectively positionable within said reservoir respectively so that the products can be adequately aerated during operating conditions;

a movable section including a secondary chassis and a cage attached thereto, said reservoir including a centrally disposed longitudinal shaft provided with a plurality of spaced spokes extending radially outwardly therefrom and along a partial length of said reservoir, said secondary chassis including a hinge and a bracket secured thereto wherein said hinge spans across a width of said primary chassis so that said cage can be pivoted about one end portion of said secondary chassis between raised and lowered positions for receiving and processing the products therein respectively;

power means for rotating said movable section along a first radial direction, said power means being operably connected to said secondary chassis; and means for mixing the products disposed within said movable section, said mixing and power means being independently rotatable during operating conditions wherein said mixing means rotates in a second radial direction.

12. The apparatus of claim 11, wherein said power means comprises:

an electric motor including a drive pulley provided with a belt attached thereto and a drive shaft extending outwardly therefrom and operably connected to said reservoir, said motor further including a belt connected thereto and at least one bearing journaled about said shaft, said motor being selectively operable by a user wherein said reservoir can be manually rotated when said motor is at an off position.

13. The apparatus of claim 12, wherein said mixing means comprises:

a first propeller operably connected to said shaft and being powered by said motor, said propeller having a plurality of blades disposed within said cage for assisting a user to control a rate at which the products are mixed during operating conditions;

a plurality of auger paddles disposed adjacent one end portion of said cage and said reservoir respectively, said auger paddles for assisting a user to feed and discharge the products during operating conditions; and a shutter removable positionable into said reservoir and having a mesh body for selectively filtering the products received from said cage; and a second propeller having a hand-operable motor attached thereto and positioned within said reservoir so that a user can selectively mix the products before passing through said shutter.

14. The apparatus of claim 11, wherein said cage further comprises:

an access door pivotally connected thereto and being disposed medially along a length thereof, said door for allowing a user to position the products directly into said cage without having to feed the products through a top end portion thereof.

15. The apparatus of claim 14, wherein said top end portion of said cage includes a screen member having a mesh surface for selectively filtering the products before entering said cage.

* * * * *